US010021940B2

(12) United States Patent
Bathum

(10) Patent No.: US 10,021,940 B2
(45) Date of Patent: Jul. 17, 2018

(54) FOOTWEAR WITH CUSTOMIZED SIDE PANELS

(75) Inventor: Dale Bathum, Sammamish, WA (US)

(73) Assignee: Crocs, Inc., Niwot, CO (US)

( * ) Notice: Subject to any disclaimer, the term of this patent is extended or adjusted under 35 U.S.C. 154(b) by 2170 days.

(21) Appl. No.: 11/829,848

(22) Filed: Jul. 27, 2007

(65) Prior Publication Data

US 2009/0025258 A1 Jan. 29, 2009

(51) Int. Cl.
*A43B 3/00* (2006.01)
*A43B 23/24* (2006.01)

(52) U.S. Cl.
CPC ..... *A43B 23/24* (2013.01); *A43B 3/0036* (2013.01); *A43B 3/0078* (2013.01)

(58) Field of Classification Search
CPC ..... A43B 3/0036; A43B 3/0078; A43B 23/24
USPC ..... 36/112, 132, 136; D2/897–900
See application file for complete search history.

(56) References Cited

U.S. PATENT DOCUMENTS

D161,374 S * 12/1950 Reinhart, Jr. et al. ..... D2/899
D164,235 S * 8/1951 Hard ..... D2/899
D174,143 S * 3/1955 Silver ..... D2/897
D178,432 S * 7/1956 Silver ..... D2/897
2,801,477 A * 8/1957 Adams ..... A43B 3/0031 36/100
D217,532 S * 5/1970 Sherman ..... D2/898
D218,004 S * 7/1970 Sherman ..... D2/898
D341,474 S * 11/1993 Winters ..... D2/897
5,377,430 A * 1/1995 Hatfield et al. ..... 36/51
D387,885 S * 12/1997 Fogg ..... D2/972
D393,351 S * 4/1998 Avar ..... D2/972
D451,664 S * 12/2001 Nguyen ..... D2/973
D485,590 S * 1/2004 Poegel, Jr. ..... D21/714
D500,199 S * 12/2004 Clegg ..... D2/972
6,957,504 B2 * 10/2005 Morris ..... A43B 1/0027 36/1
7,041,015 B2 * 5/2006 Sowders ..... 473/422
7,080,466 B2 * 7/2006 Fischbein ..... 36/9 R

* cited by examiner

*Primary Examiner* — Sharon M Prange
(74) *Attorney, Agent, or Firm* — Wilmer Cutler Pickering Hale and Dorr LLP

(57) ABSTRACT

Shoes with customized side panels including hand gesture elements are disclosed herein. In one embodiment, a shoe can include a sole assembly and an upper coupled to the sole assembly and including a first side panel and a second side panel generally opposite the first side panel. The shoe also includes a hand gesture element on at least one of the first side panel and the second side panel. The hand gesture element can include any type of hand gesture that is expressive of an idea, opinion, emotion, etc. It is emphasized that this abstract is provided to comply with the rules requiring an abstract. It is submitted with the understanding that it will not be used to interpret or limit the scope or meaning of the claims (37 C.F.R. 1.72(b)).

28 Claims, 18 Drawing Sheets

FOOTWEAR WITH CUSTOMIZED SIDE PANELS

TECHNICAL FIELD

The present disclosure is directed toward footwear and, more particularly, toward shoes with side panels including decorative elements.

DETAILED DESCRIPTION

The present disclosure is directed to shoes with side panels including simulated hand gesture elements. Many specific details of certain embodiments of the invention are set forth in the following description and in FIGS. 1-36 to provide a thorough understanding of these embodiments. Well-known structures, components, and methods often associated with such structures have not been shown or described in detail to avoid unnecessarily obscuring the description of the various embodiments of the invention. In addition, those of ordinary skill in the relevant art will understand that additional embodiments of the invention may be practiced without several of the details described below.

Figure 1:
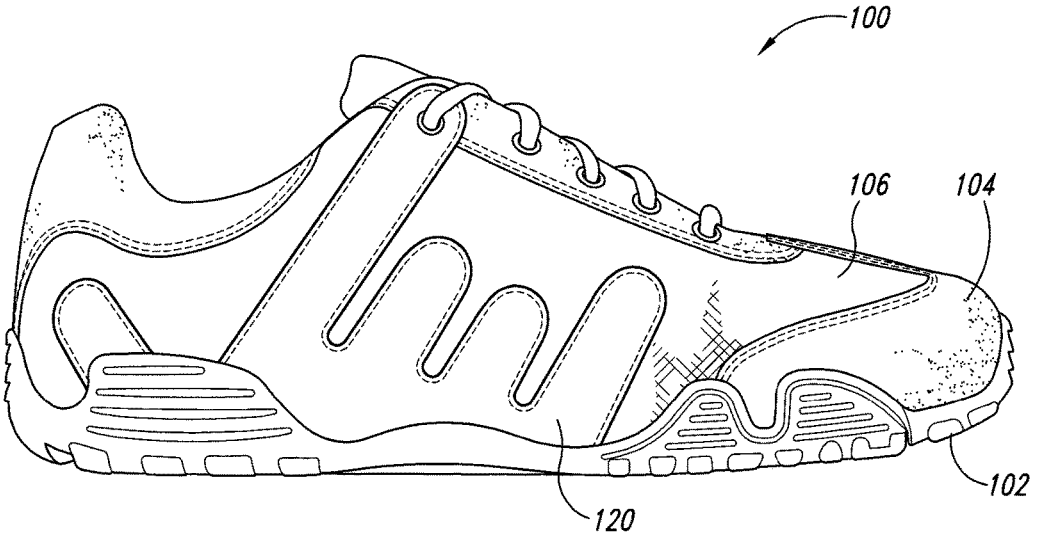
FIG. 1 is a right side view of a shoe including a simulated hand gesture element configured in accordance with an embodiment of the invention.
Figure 2:
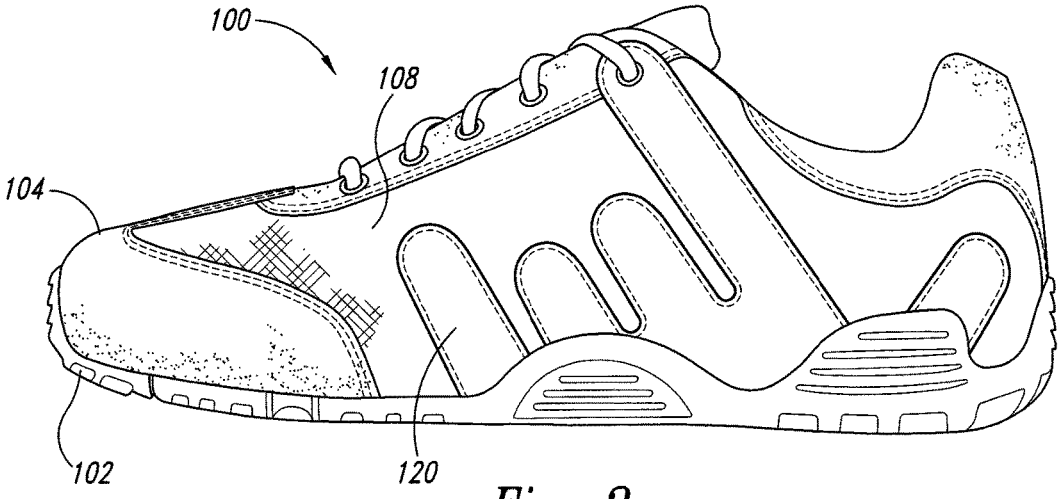
FIG. 2 is a left side view of the athletic shoe of FIG. 1.
Figure 3:
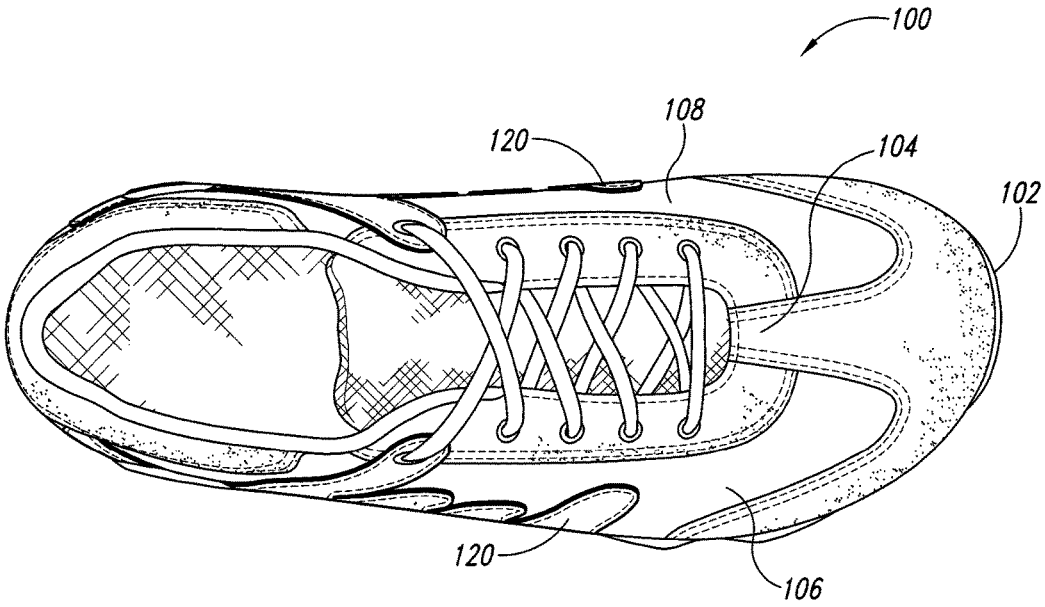
FIG. 3 is a top view of the athletic shoe of FIG. 1.
Figure 4:
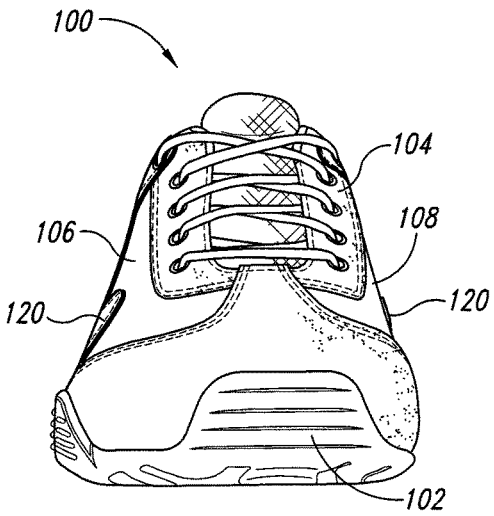
FIG. 4 is a front elevation view of the athletic shoe of FIG. 1.
Figure 5:
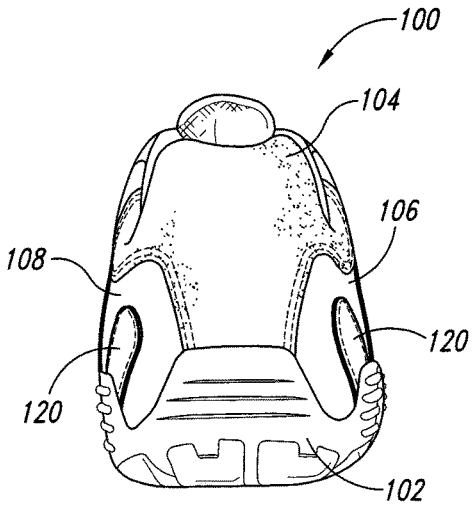
FIG. 5 is a rear elevation view of the athletic shoe of FIG. 1.
Figure 6:
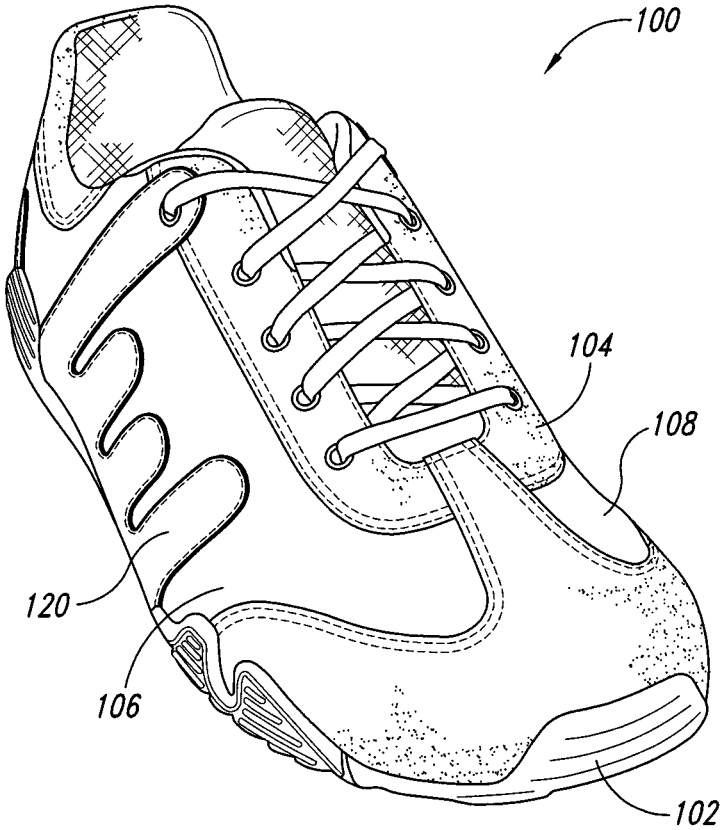
FIG. 6 is a front isometric view of the athletic shoe of FIG. 1.
Figure 7:
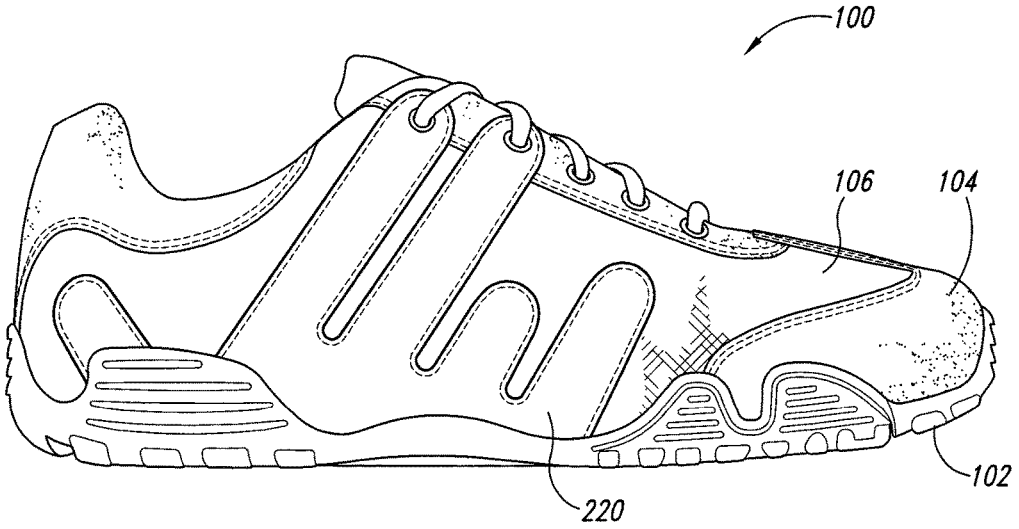
FIG. 7 is a right side view of a shoe including a simulated hand gesture element configured in accordance with another embodiment of the invention.
Figure 8:
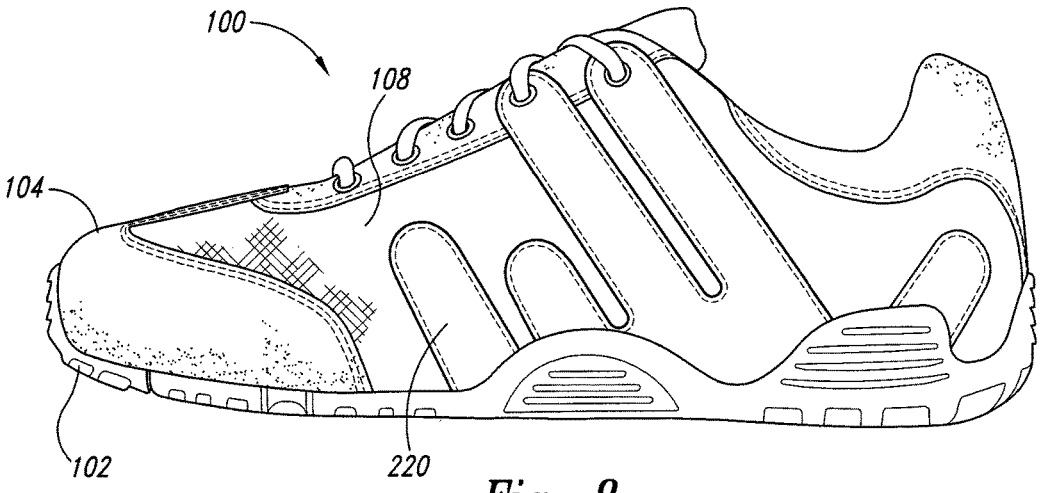
FIG. 8 is a left side view of the athletic shoe of FIG. 7.
Figure 9:
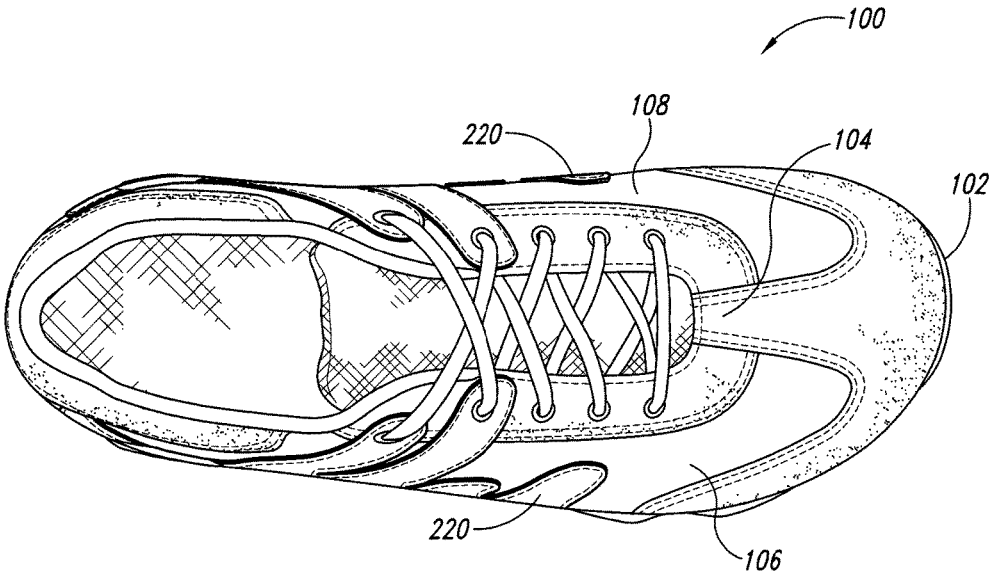
FIG. 9 is a top view of the athletic shoe of FIG. 7.
Figure 10:
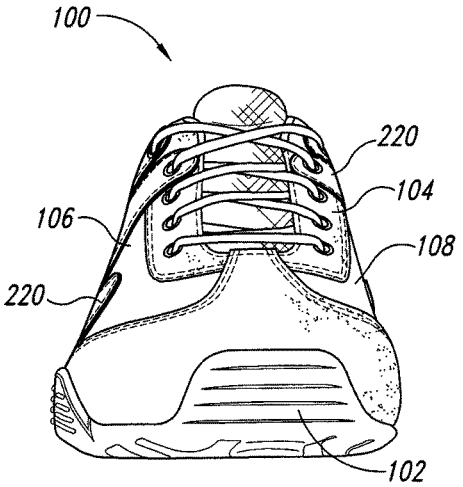
FIG. 10 is a front elevation view of the athletic shoe of FIG. 7.
Figure 11:
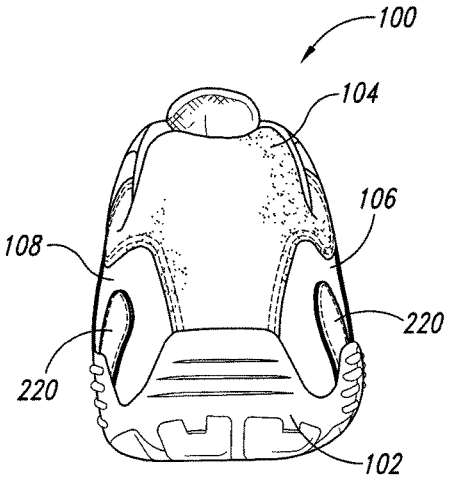
FIG. 11 is a rear elevation view of the athletic shoe of FIG. 7.
Figure 12:
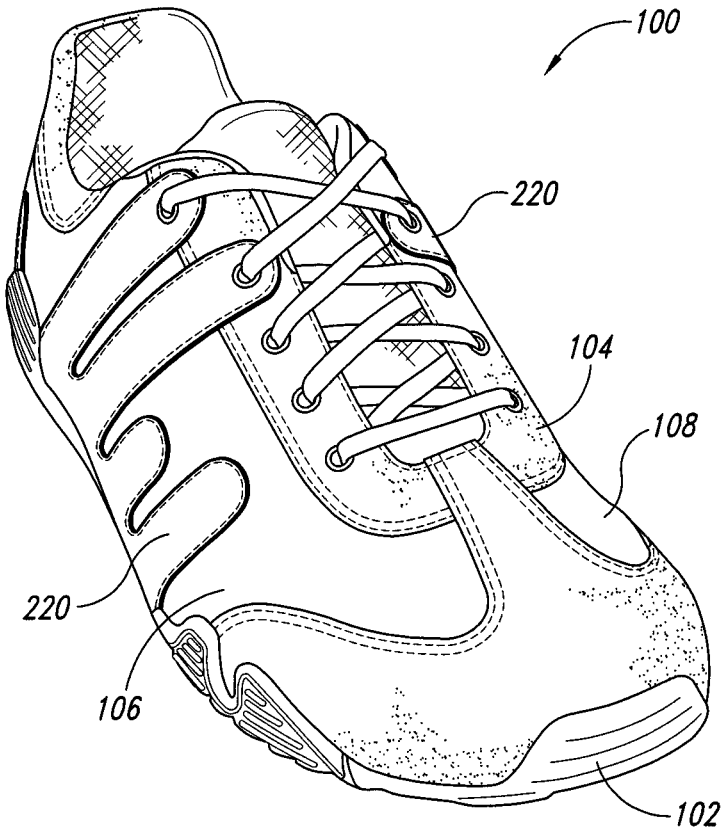
FIG. 12 is a front isometric view of the athletic shoe of FIG. 7.
Figure 13:
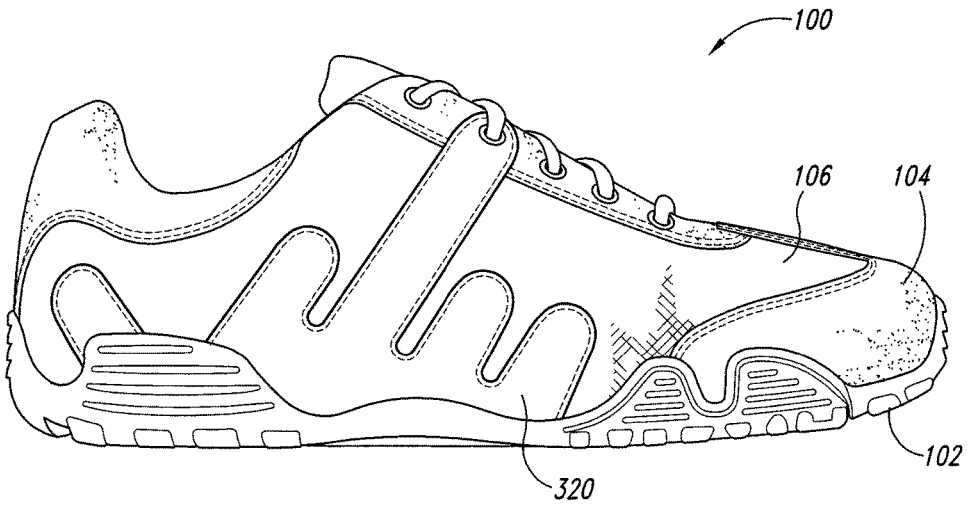
FIG. 13 is a right side view of a shoe including a simulated hand gesture element configured in accordance with another embodiment of the invention.
Figure 14:
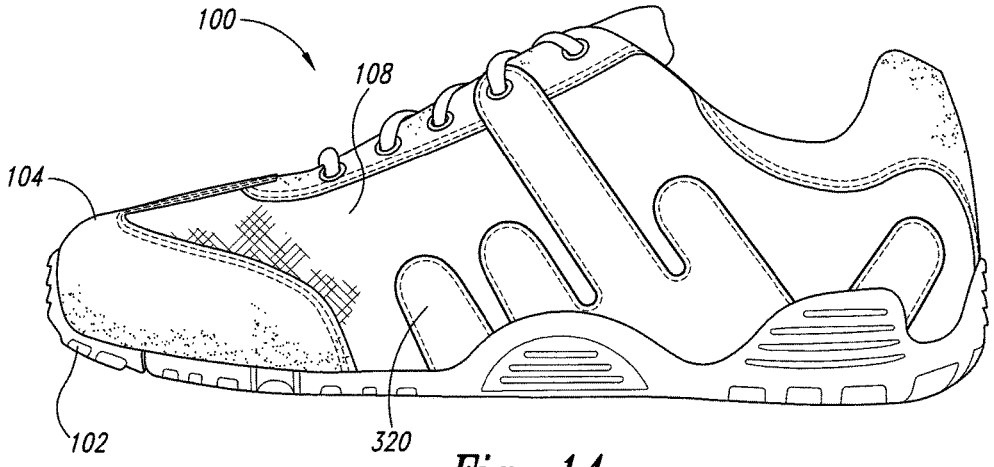
FIG. 14 is a left side view of the athletic shoe of FIG. 13.
Figure 15:
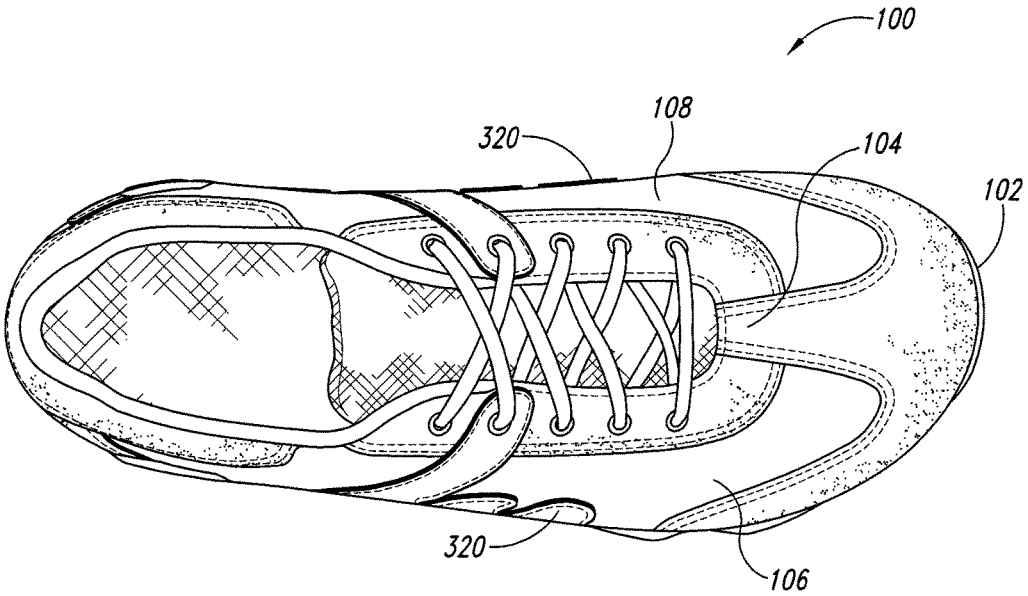
FIG. 15 is a top view of the athletic shoe of FIG. 13.
Figure 16:
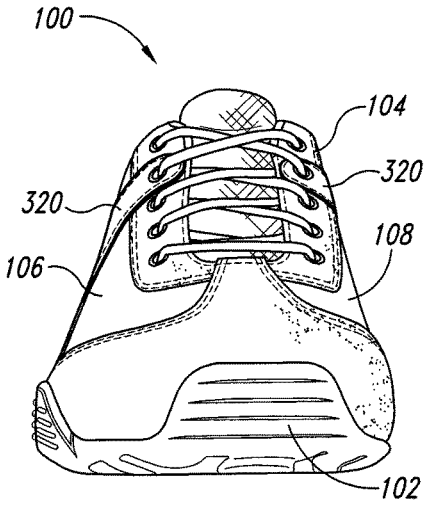
FIG. 16 is a front elevation view of the athletic shoe of FIG. 13.
Figure 17:
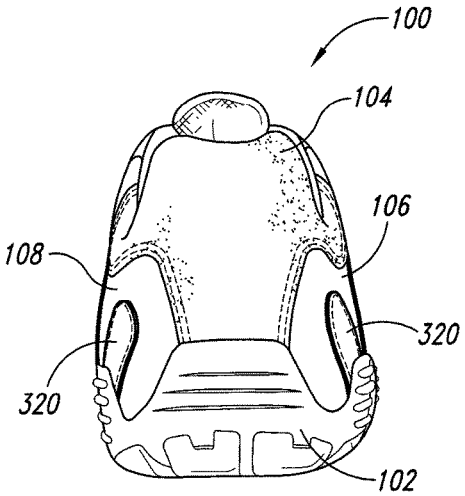
FIG. 17 is a rear elevation view of the athletic shoe of FIG. 13.
Figure 18:
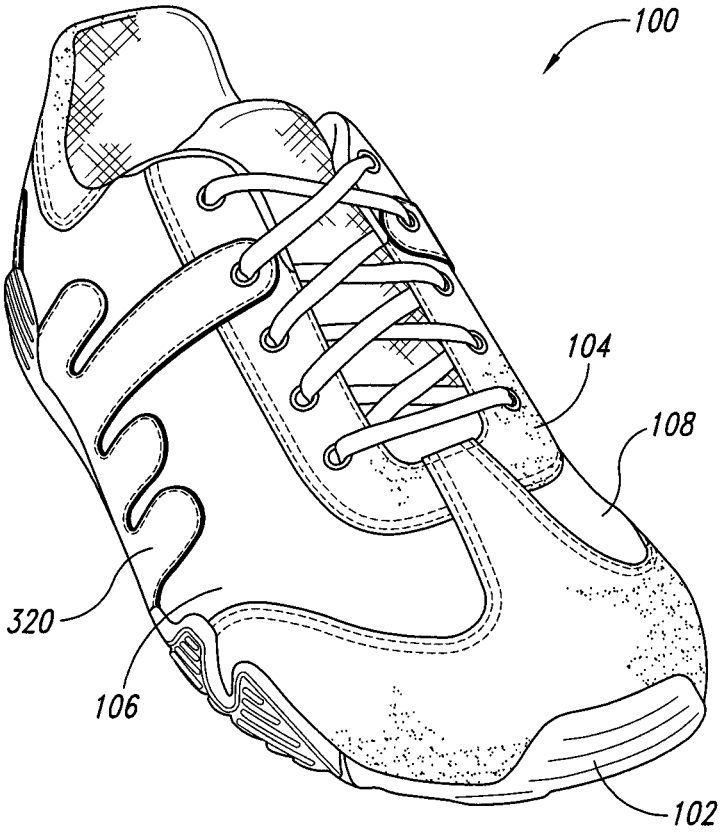
FIG. 18 is a front isometric view of the athletic shoe of FIG. 13.
Figure 19:
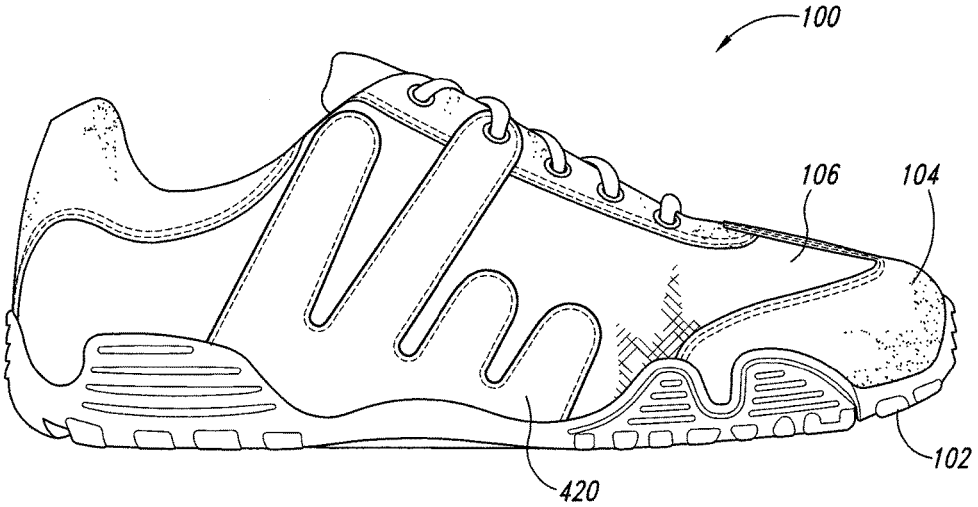
FIG. 19 is a right side view of a shoe including a simulated hand gesture element configured in accordance with another embodiment of the invention.
Figure 20:
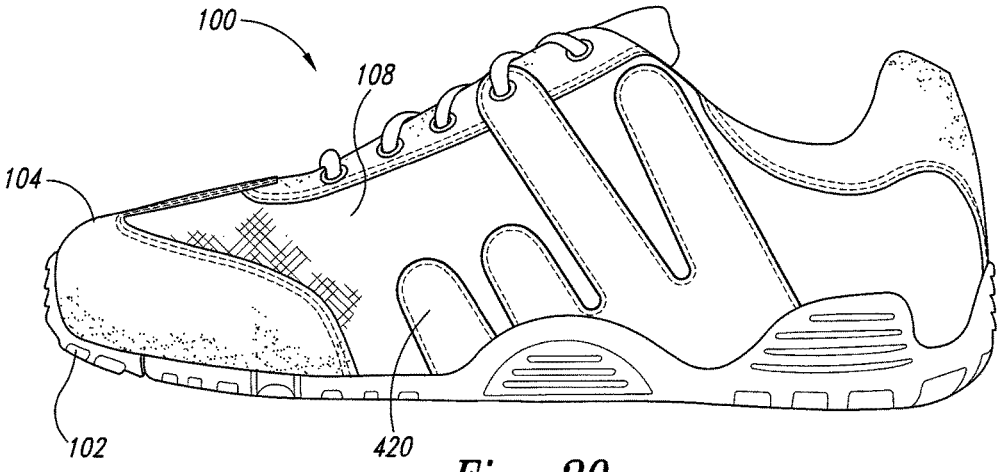
FIG. 20 is a left side view of the athletic shoe of FIG. 19.
Figure 21:
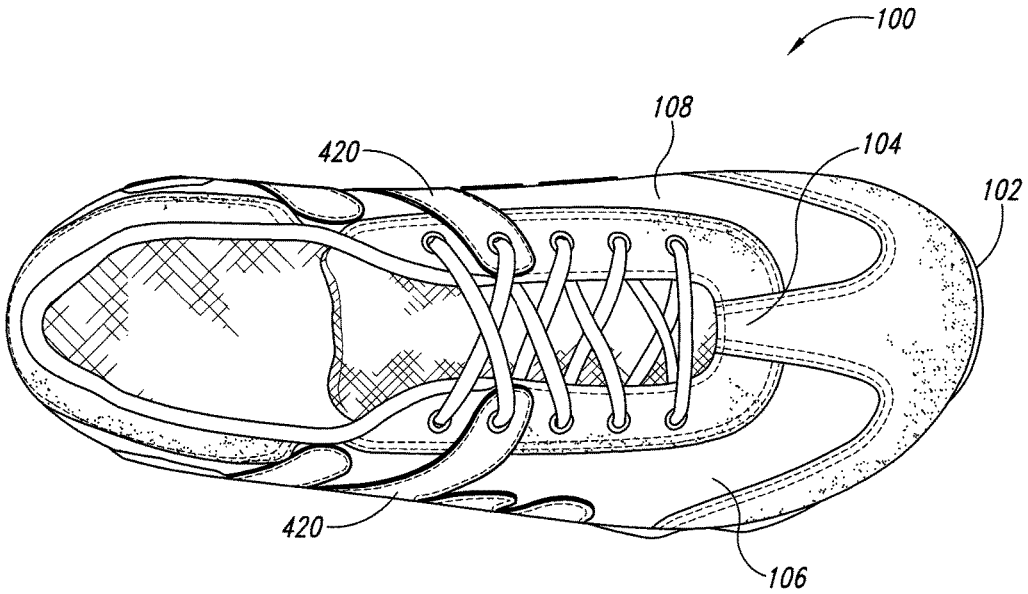
FIG. 21 is a top view of the athletic shoe of FIG. 19.
Figure 22:
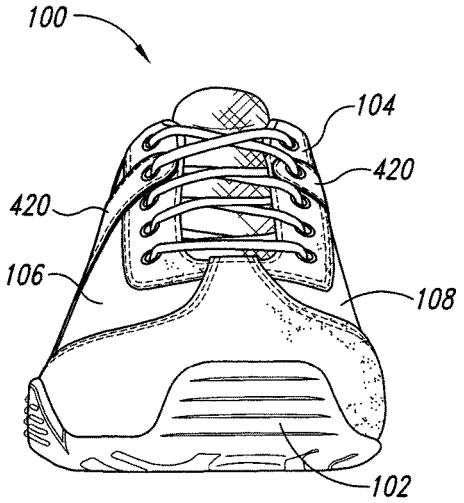
FIG. 22 is a front elevation view of the athletic shoe of FIG. 19.
Figure 23:
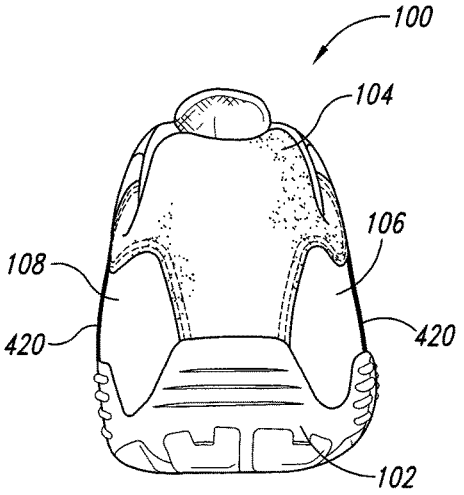
FIG. 23 is a rear elevation view of the athletic shoe of FIG. 19.
Figure 24:
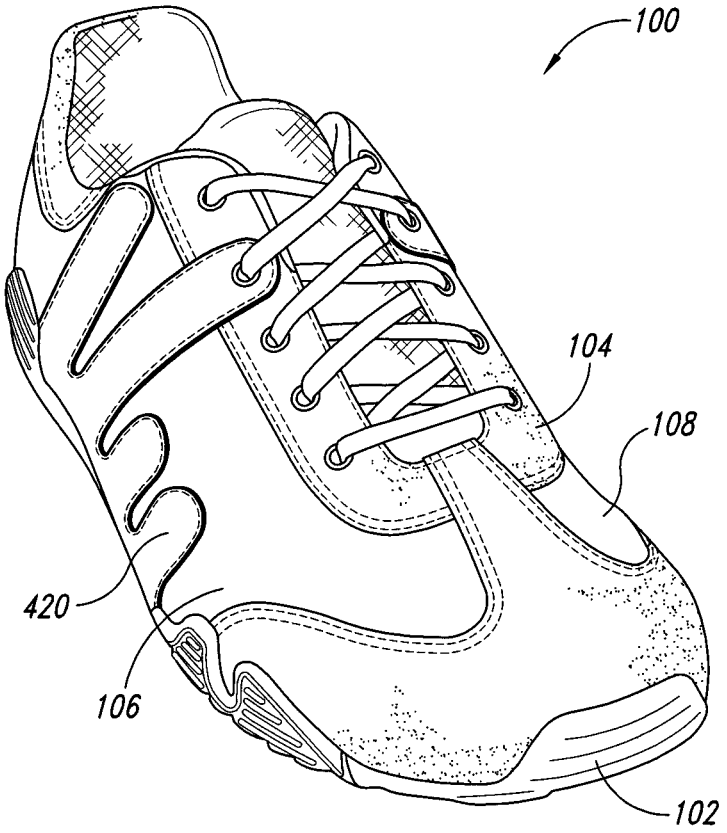
FIG. 24 is a front isometric view of the athletic shoe of FIG. 19.
Figure 25:
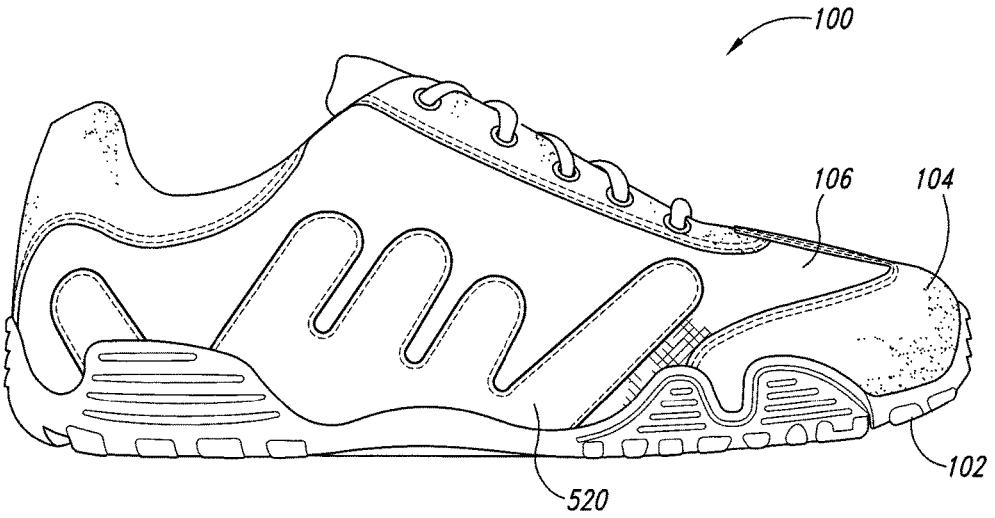
FIG. 25 is a right side view of a shoe including a hand gesture element configured in accordance with another embodiment of the invention.
Figure 26:
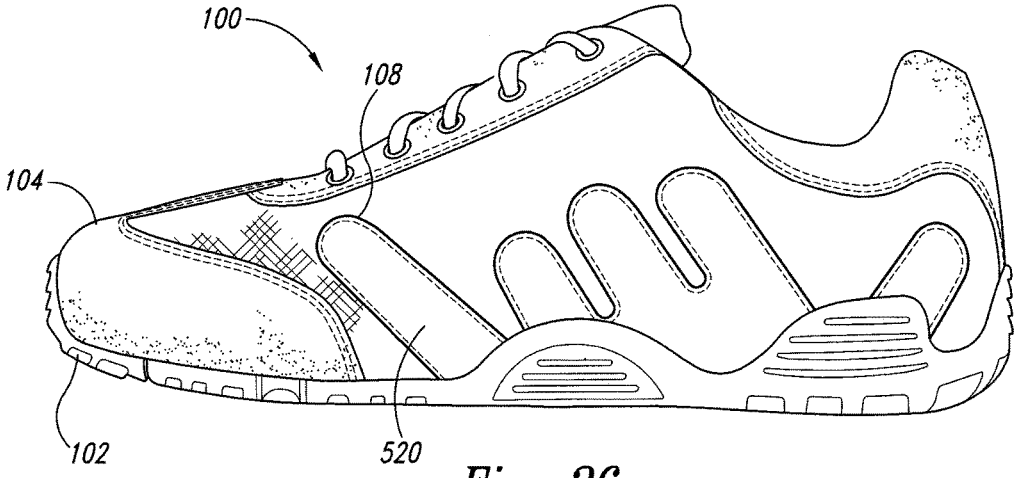
FIG. 26 is a left side view of the athletic shoe of FIG. 25.
Figure 27:
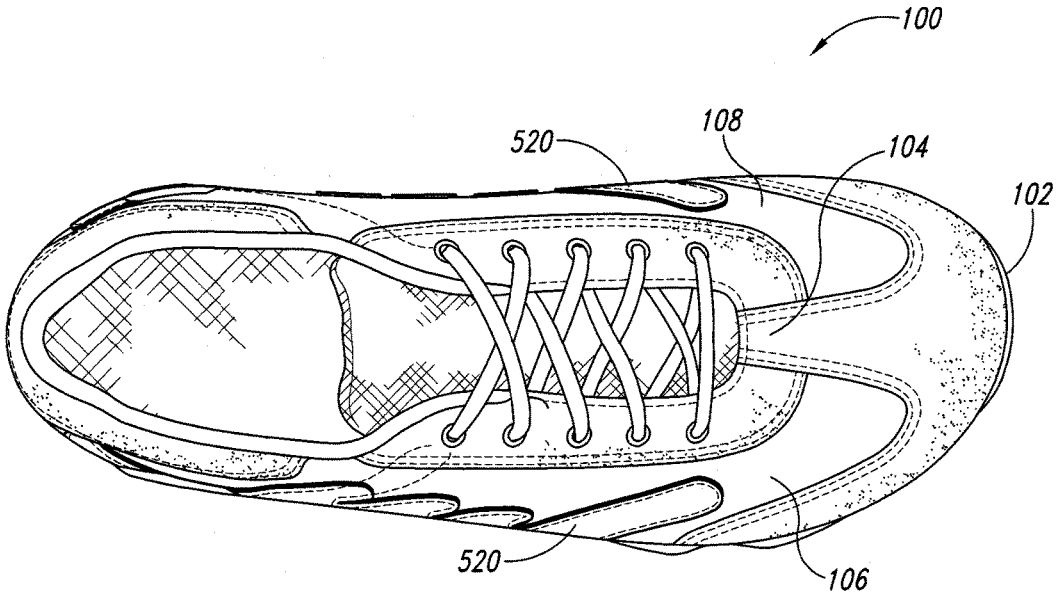
FIG. 27 is a top view of the athletic shoe of FIG. 25.
Figure 28:
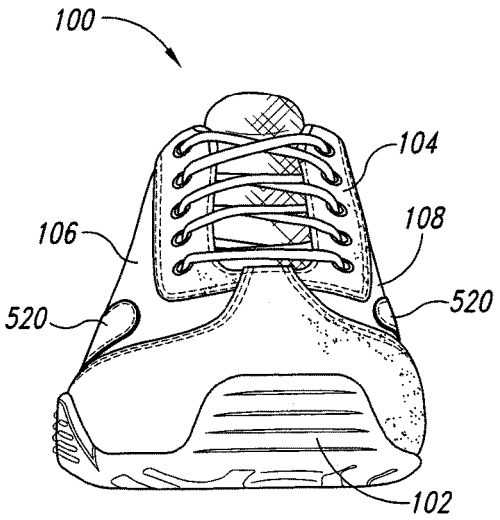
FIG. 28 is a front elevation view of the athletic shoe of FIG. 25.
Figure 29:
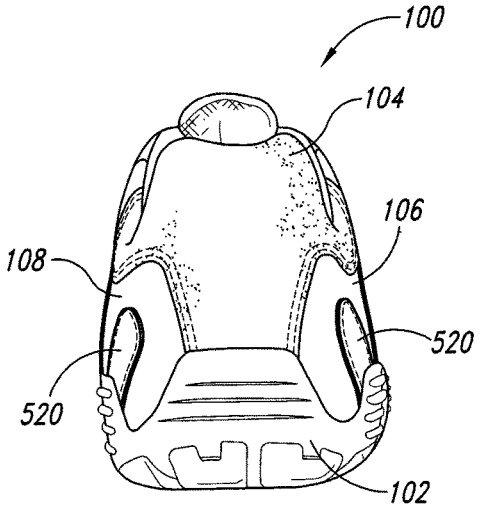
FIG. 29 is a rear elevation view of the athletic shoe of FIG. 25.
Figure 30:
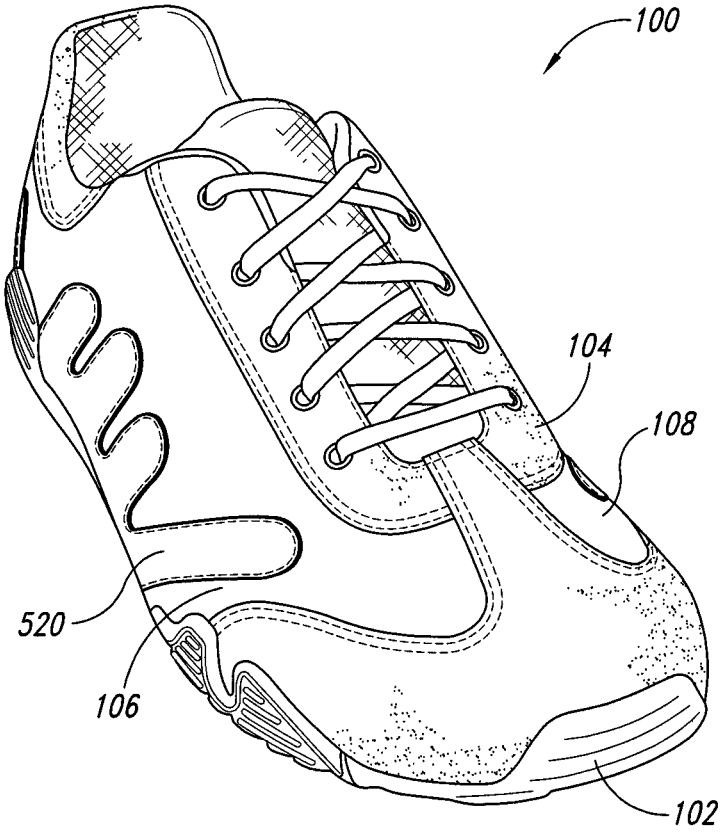
FIG. 30 is a front isometric view of the athletic shoe of FIG. 25.
Figure 31:
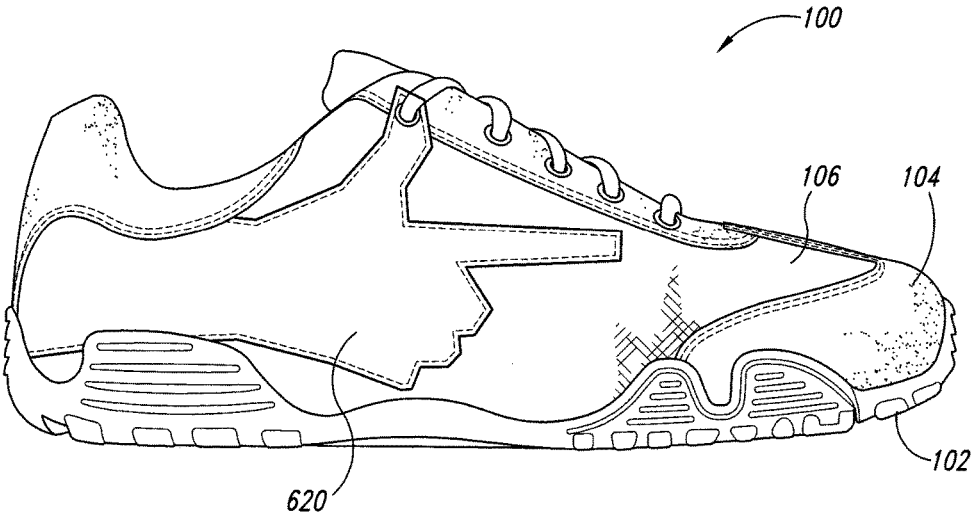
FIG. 31 is a right side view of a shoe including a hand gesture element configured in accordance with another embodiment of the invention.
Figure 32:
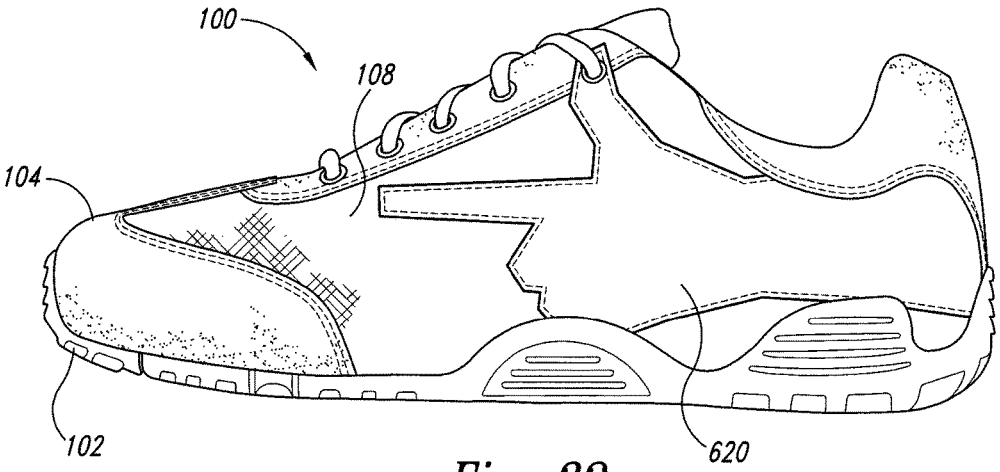
FIG. 32 is a left side view of the athletic shoe of FIG. 31.
Figure 33:
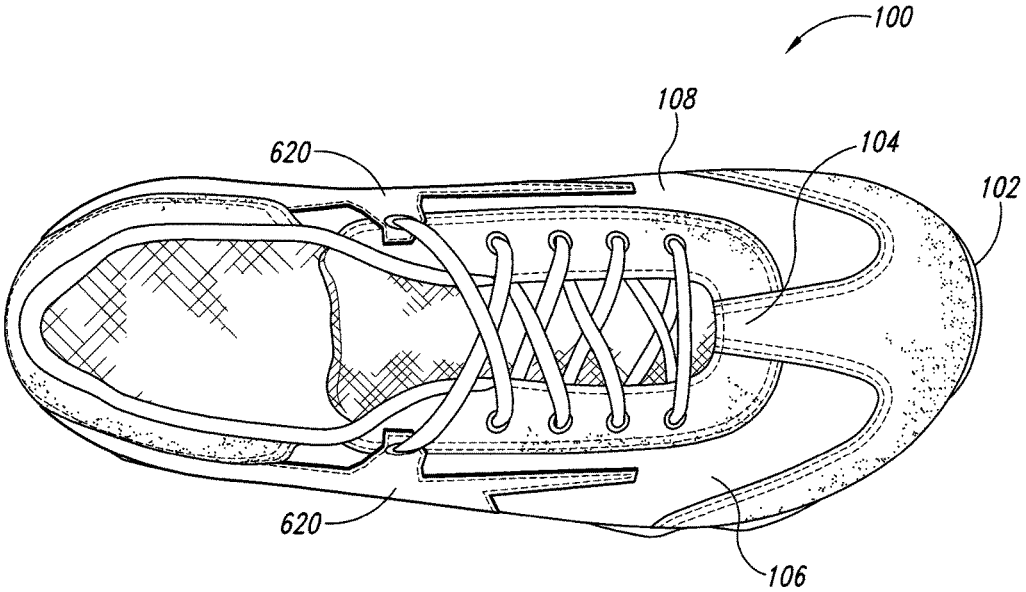
FIG. 33 is a top view of the athletic shoe of FIG. 31.
Figure 34:
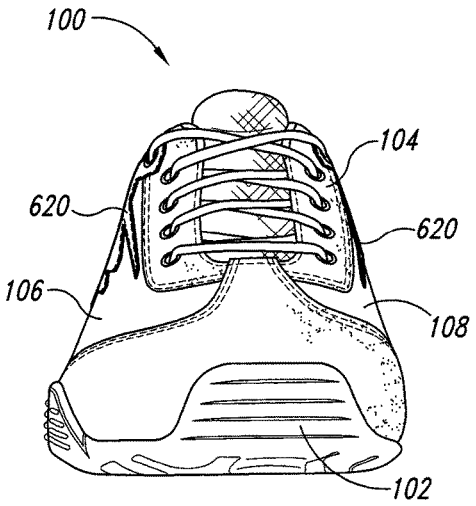
FIG. 34 is a front elevation view of the athletic shoe of FIG. 31.
Figure 35:
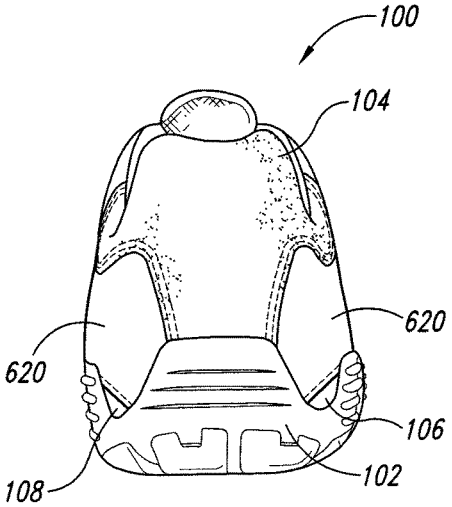
FIG. 35 is a rear elevation view of the athletic shoe of FIG. 31.
Figure 36:
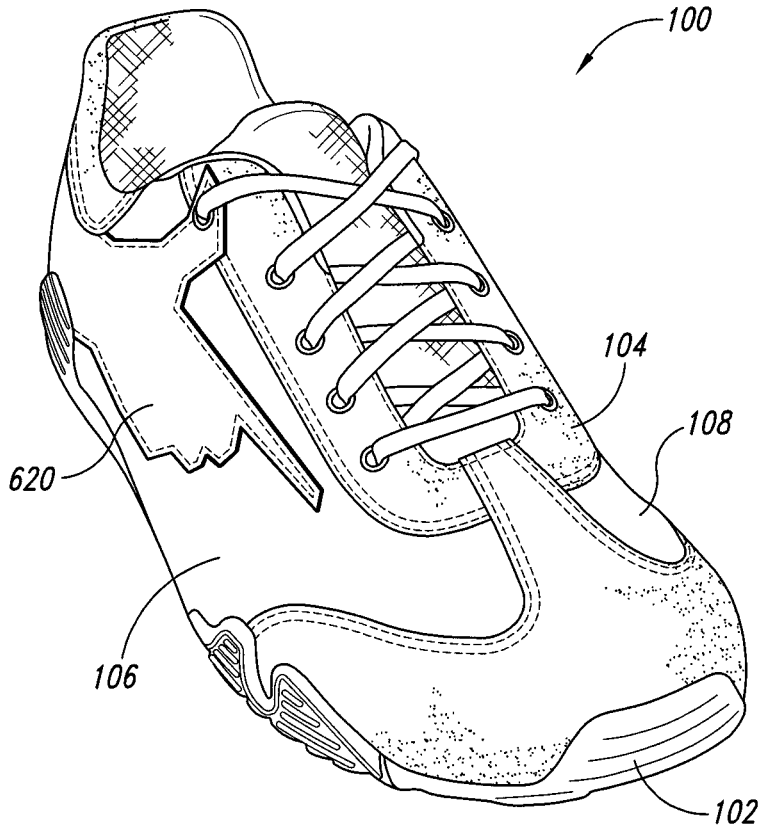
FIG. 36 is a front isometric view of the athletic shoe of FIG. 31.

FIG. 1 is a right side view of a shoe 100 including a simulated hand gesture element 120 configured in accordance with an embodiment of the invention. FIGS. 2-6 illustrate additional views of the shoe 100 and hand gesture element 120. Referring to FIGS. 1-6 together, the shoe 100 includes a sole or base assembly 102 and an upper 104 attached to the sole 102. The upper 104 includes a first or right side panel 106 (best seen in FIG. 1) and a second or left side panel 108 (best seen in FIG. 2). One or more hand gesture elements 120 are positioned on at least one of the right side panel 106 and the left side panel 108. In the illustrated embodiment, for example, the right and left side panels 106 and 108 each include the hand gesture element 120. In other embodiments, however, the hand gesture element 120 may be on only one of the side panels and/or the side panels can include a different number of hand gesture elements 120.

The side panels 106 and 108 can be any one of a plurality of colors or combination of colors. The left and right side panels 106 and 108 can be the same color or combination of colors, or the side panels can be different colors or combination of colors from each other. The simulated hand gesture elements 120 can be one or more similar or contrasting colors relative to the side panels. The simulated hand gestures can be made of one or more materials, which may be the same or different from one or more materials forming the side panels. In one embodiment, the simulated hand gesture element 120 is permanently attached to the respective side panel. In another embodiment, the simulated hand gesture element can be removably attached or adjustably attached to the respective side panel.

The hand gesture element 120 in the illustrated embodiment simulates at least a portion of a hand 150 having a plurality of fingers 151-154 and a thumb 155. One or more of the fingers 151-154 and/or the thumb 155 can be configured to simulate a folded position, a partially extended position, or an extended position of the respective finger or thumb to form the simulated hand gesture. For example, FIGS. 1-6 illustrate at least a portion of the hand 150 with the thumb 155 and two fingers 151 and 154 representing the pinky finger and the index finger extended, and the middle and ring fingers shown folded to form an American Sign Language hand gesture for the phrase "I love you." In other embodiments, however, the shoe 100 can include different hand gesture elements that are expressive of an idea, phrase, symbol, opinion, emotion, etc. FIGS. 7-36, for example, illustrate the shoe 100 with a variety of different hand gesture elements 220/320/420/520/620 on the right and left side panels 106 and 108 with various combinations of the simulated fingers 151-154 and thumb 155 in folded, partially extended, or extended positions. In still other embodiments, other types of hand gestures can be used and/or the hand gestures can be positioned on different portions of the shoe 100 in addition to, or in lieu of, the right and left side panels 106 and 108.

In the illustrated embodiment, the simulated hand gesture 120 is shown as a silhouette of the hand or portions of the hand, such that anatomical details of the hand 150, such as fingernails, knuckles, skin texture, etc., are not shown. In other embodiments, one or more anatomical features of the hand can be simulated or represented. In other embodiments, the simulated hand can include simulated decorative items or features, such as rings, jewelry, watches, tattoos, bands, bracelets, etc.

From the foregoing, it will be appreciated that specific embodiments of the invention have been described herein for purposes of illustration, but that various modifications may be made without deviating from the invention. For example, the hand gesture elements can be placed on any type of footwear (e.g., skate shoes, snowboard boots, fashion footwear, Heelys®, sandals, etc.). Moreover, in still other embodiments, a shoe can include different hand gesture elements on each side panel. For example, a shoe may have a first hand gesture element on the right side panel and a second, different hand gesture element on the left side panel. Aspects of the invention described in the context of particular embodiments may be combined or eliminated in other embodiments. Accordingly, the invention is not limited, except as by the appended claims.

I claim:

1. A shoe assembly, comprising:

a sole assembly;

an upper coupled to the sole assembly, the upper including a first panel, a toe end, a heel end, a medial side, and a lateral side, the medial and lateral sides extending from the toe end to the heel end; and a hand gesture element on the first panel, the hand gesture element including at least three simulated digits of a hand, wherein at least one of the at least three simulated digits is in a simulated position other than a fully extended position;

wherein the at least three simulated digits of the hand are formed by a perimeter of the hand gesture element, and wherein an area formed by the perimeter of the hand gesture element is visually presented on the medial or lateral side of the upper, and wherein the area formed by the perimeter of the hand gesture element extends at least halfway from the sole assembly to the top of the shoe assembly.

2. The shoe assembly of claim 1 wherein the first panel is a first side panel and the upper further comprises a second side panel that is located generally opposite the first side panel, and wherein the hand gesture element is on each of the first side panel and the second side panel.

3. The shoe assembly of claim 1 wherein the upper further comprises a second panel, wherein the hand gesture element is a first hand gesture element, and wherein the shoe further comprises a second hand gesture element on the second panel that is different from the first hand gesture element.

4. The shoe assembly of claim 1 wherein the hand gesture element includes a pattern of material attached to the first panel.

5. The shoe assembly of claim 4, wherein the hand gesture element is stitched onto the first side panel.

6. The shoe assembly of claim 4, wherein the hand gesture element includes a simulated wrist.

7. The shoe assembly of claim 1 wherein the at least three simulated digits include at least two simulated fingers and a simulated thumb.

8. The shoe assembly of claim 1 wherein the hand gesture element is representative of a silhouette of a portion of the hand.

9. The shoe assembly of claim 1, wherein at least one of the at least three simulated digits intersects an eyelet configured to receive a shoelace.

10. The shoe assembly of claim 1, wherein the hand gesture element is a first hand gesture element, wherein the at least three simulated digits of the hand are a first set of at least three simulated digits of the hand, the shoe assembly further comprising:

a second sole assembly;

a second upper coupled to the second sole assembly, the second upper including a second panel; and a second hand gesture element on the second panel, the second hand gesture element including a second set of at least three simulated digits of the hand, wherein the first hand gesture element is different from the second hand gesture element.

11. The shoe assembly of claim 1, wherein the first panel is at least partially bounded by the sole assembly and by an eyelet portion of the upper, and wherein the hand gesture element extends from the sole assembly towards the eyelet portion of the upper.

12. The shoe assembly of claim 1, wherein the first panel is at least partially bounded by a toe portion of the upper, a heel portion of the upper, the sole assembly, and an eyelet portion of the upper, wherein the hand gesture element extends from the sole assembly to the eyelet portion of the upper.

13. The shoe assembly of claim 1, wherein the hand gesture element includes a simulated palm portion of the hand that connects at least two of the at least three simulated digits.

14. The shoe assembly of claim 1, wherein the hand gesture element includes a pattern of material attached to the first panel to simulate a portion of a palm.

15. The shoe assembly of claim 14, wherein the pattern of material attached to the first panel to simulate the portion of the palm is unitarily formed as a first pattern of material, and is unitarily formed with a second pattern of material attached to the first panel to simulate the at least three simulated digits of the hand.

16. The shoe assembly of claim 15, wherein the first panel is at least partially bounded by a toe portion of the upper, a heel portion of the upper, the sole assembly, and an eyelet portion of the upper, wherein the hand gesture element extends from the sole assembly to the eyelet portion of the upper.

17. The shoe assembly of claim 14, wherein a bottom edge of the material attached to the first panel to simulate the portion of the palm is adjacent a top edge of the sole assembly.

18. A footwear assembly, comprising:

a sole;

an upper having a first side panel and a second side panel, a toe end, a heel end, a medial side, and a lateral side, the medial and lateral sides extending from toe end to heel end, the second side panel located generally opposite the first side panel; and a hand gesture element on the first side panel, the hand gesture element including at least first and second simulated portions of a hand and at least three simulated digits of the hand, wherein at least one of the at least three simulated digits is in a simulated position other than a fully extended position, wherein the at least first and second simulated portions of the hand and the at least three simulated digits of the hand are formed by a perimeter of the hand gesture element, and wherein an area formed by the perimeter of the hand gesture element is visually presented on the medial or lateral side of the upper, and wherein the area formed by the perimeter of the hand gesture element extends at least halfway from the sole to the top of the footwear assembly.

19. The footwear assembly of claim 18 wherein the hand gesture element is a first hand gesture element, the footwear assembly further comprising a second hand gesture element on the second side panel, wherein the second hand gesture element is substantially the same as the first hand gesture element.

20. The footwear assembly of claim 18 wherein the hand gesture element is a first hand gesture element, and wherein the footwear assembly further comprises a second hand gesture element on the second side panel that is different from the first hand gesture element.

21. The footwear assembly of claim 18 wherein the hand gesture element includes a pattern of material attached to the upper, and wherein the first simulated portion of the hand includes a simulated portion of a palm that connects the at least three simulated digits of the hand.

22. The footwear assembly of claim 18 wherein the at least three simulated digits include at least two simulated fingers and a simulated thumb.

23. The footwear assembly of claim 18 wherein the hand gesture element is representative of a silhouette of the first simulated portion of the hand or of at least one of the at least three simulated digits.

24. A footwear assembly comprising:

a sole;

an upper having a first panel and a second panel, a toe end, a heel end, a medial side, and a lateral side, the medial and lateral sides extending from toe end to heel end; and a hand gesture element on the first panel, the hand gesture element including at least five simulated digits of a hand, wherein the at least five simulated digits of the hand comprise at least four simulated fingers and at least one simulated thumb, and wherein at least one of the at least five simulated digits is in a simulated position other than a fully extended position wherein the at least five simulated digits of the hand are formed by a perimeter of the hand gesture element, and wherein an area formed by the perimeter of the hand gesture element is visually presented on the medial or lateral side of the upper, and wherein the area formed by the perimeter of the hand gesture element extends at least halfway from the sole to the top of the footwear assembly.

25. The footwear assembly of claim 24, wherein at least two of the at least five simulated digits are in simulated positions other than the fully extended position.

26. The footwear assembly of claim 24, wherein at least three of the at least five simulated digits are in simulated positions other than the fully extended position.

27. The footwear assembly of claim 24, wherein the at least one of the at least five simulated digits is in a simulated folded position.

28. The footwear assembly of claim 24, wherein the at least one of the at least five simulated digits is in a simulated partially extended position.

* * * * *